US006428627B1

(12) United States Patent
Witt et al.

(10) Patent No.: US 6,428,627 B1
(45) Date of Patent: Aug. 6, 2002

(54) FLOW HEATER

(75) Inventors: Allan E. Witt, Brown Deer; Kenneth Hays, Sturgeon Bay, both of WI (US)

(73) Assignee: Hatco Corporation, Milwaukee, WI (US)

( * ) Notice: Subject to any disclaimer, the term of this patent is extended or adjusted under 35 U.S.C. 154(b) by 0 days.

(21) Appl. No.: 09/525,893

(22) Filed: Mar. 15, 2000

(51) Int. Cl.[7] ..... B08B 3/10

(52) U.S. Cl. ..... 134/35; 134/106; 134/107; 134/108

(58) Field of Search ..... 134/105, 106, 134/107, 108, 35, 104.1

(56) References Cited

U.S. PATENT DOCUMENTS

| | | | | | |
|---|---|---|---|---|---|
| 131,582 | A | * | 9/1872 | Wheeler | |
| 446,572 | A | * | 2/1891 | Proctor et al. | |
| 707,443 | A | * | 8/1902 | Morley | |
| 817,593 | A | * | 4/1906 | Shipp | |
| 817,802 | A | * | 4/1906 | Pittcok | |
| 852,854 | A | * | 5/1907 | Shoenberg | |
| 1,154,440 | A | * | 9/1915 | Schubert | |
| 1,335,853 | A | * | 4/1920 | Myrick | 134/106 |
| 1,388,249 | A | * | 8/1921 | Freter | 134/106 |
| 1,819,618 | A | * | 8/1931 | Munters | |
| 1,836,373 | A | * | 12/1931 | Kadesch | 13/106 |
| 1,865,289 | A | * | 6/1932 | Trowbridge | 134/106 |
| 2,170,730 | A | * | 8/1939 | Rodieck | |
| 2,190,165 | A | * | 2/1940 | Shurts | |
| 2,233,968 | A | * | 3/1941 | White | |
| 2,251,411 | A | * | 8/1941 | Metzgar | |
| 2,431,246 | A | * | 11/1947 | Hallanan | 134/106 |
| 2,582,103 | A | * | 1/1952 | Clegg | 134/35 |
| 3,234,047 | A | * | 2/1966 | Olson | |
| 3,636,308 | A | * | 1/1972 | Hatch | |
| 4,169,978 | A | * | 10/1979 | Hauslien | |
| 4,574,183 | A | * | 3/1986 | Kanuss | |
| 4,872,466 | A | | 10/1989 | Noren | |
| 4,947,983 | A | * | 8/1990 | Jost | |
| 5,138,693 | A | * | 8/1992 | Knauss | |
| 5,333,683 | A | * | 8/1994 | Arriulou et al. | |
| 5,943,944 | A | | 8/1999 | Lassota | |

FOREIGN PATENT DOCUMENTS

| | | | | |
|---|---|---|---|---|
| AT | 132293 | * | 3/1933 | 134/106 |
| FR | 1008656 | * | 5/1952 | 134/106 |

* cited by examiner

*Primary Examiner*—Frankie L. Stinson
(74) *Attorney, Agent, or Firm*—Foley & Lardner

(57) ABSTRACT

A flow heater for a sink heater or rethermalizing system is disclosed. The flow heater includes a flow tube in fluid communication with a fluid receptacle. The flow tube has a heating element that is in conductive communication with the flow tube and helically encircles the flow tube. Fluid flowing through the flow tube is caused by thermal siphoning affects. The flow heater system may be used for sanitizing dishware in a sink or for rethermalizing packaged foods.

19 Claims, 3 Drawing Sheets

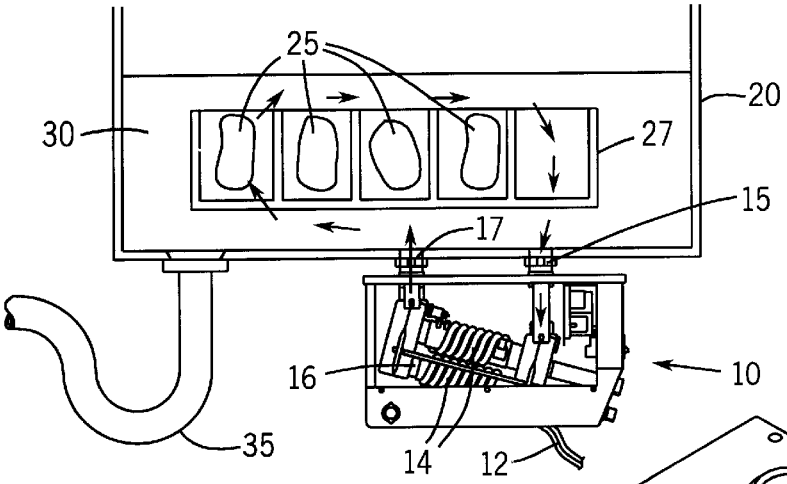
FIG. 1
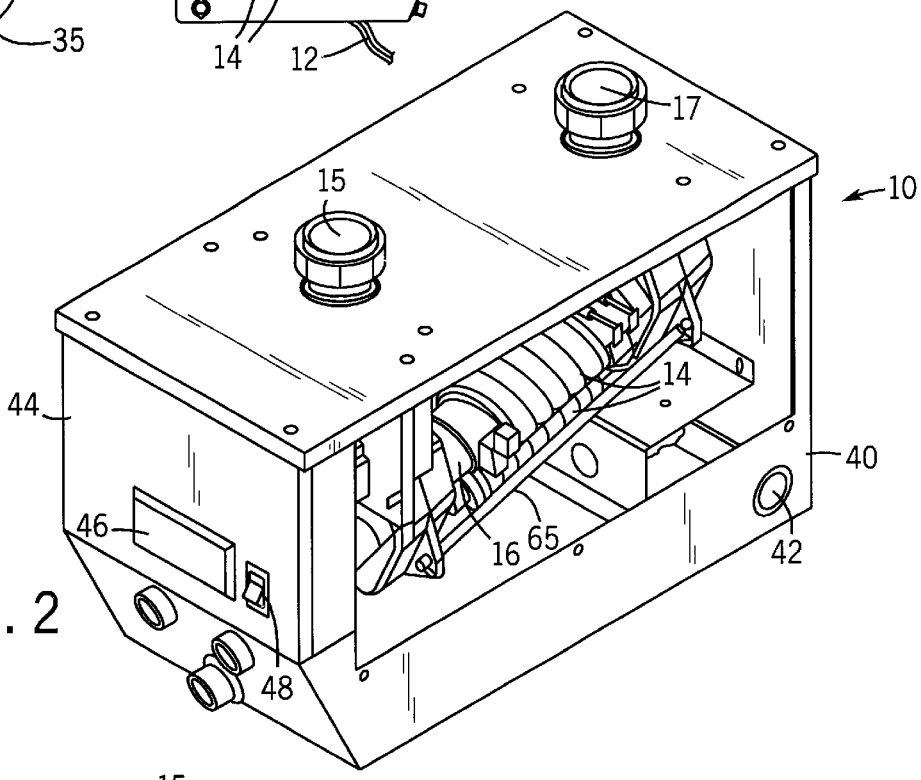
FIG. 2
FIG. 3
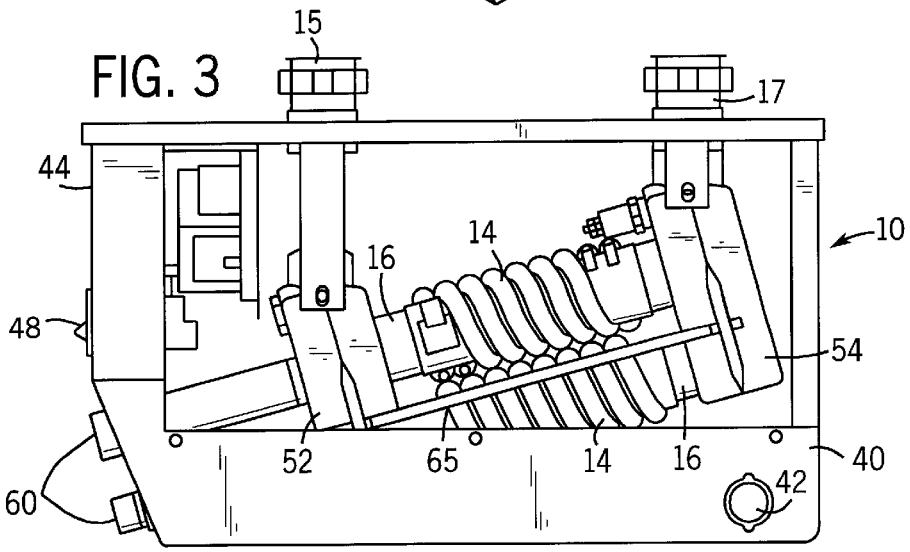

FLOW HEATER

FIELD OF THE INVENTION

The invention relates to a rethermalizing heater or sink heater. The rethermalizing heater or sink heater uses a single tube or multiple tubes with external heating elements in thermally conductive contact with the tube or tubes, providing heat transfer to liquid flowing through the tubes. Liquid is circulated through the tubes and into a tank or sink through the process of thermal siphoning.

BACKGROUND OF THE INVENTION

Recirculation of water, or other liquids, for example cleaning solutions, is a process commonly used in the food industry. For example, recirculation of wash water has been used in dishwashers. In such a recirculating dishwasher, a tank is used as a relatively large reservoir that is filled with a solution of water and detergent for washing. The water and detergent solution is recycled for washing successive racks with a large percentage of the same liquid being recirculated. The liquid is somewhat diluted with fresh rinse water after each cycle. A drain valve is typically located at the bottom of a tank. Further, an overflow may be located near the top of the tank. The fresh water spray system rinses the racks of dishware at the proper time in a cycle, after it has been washed by pumped recirculation of the large volume of wash water. The wash water is typically heated by a heater that acts as a heat sink to maintain water temperature. Often, such a heater is an electrical heating element submerged in the wash water tank. Using a submerged heating element has the disadvantage that lime and other mineral build-up is caused on the heating element. Such lime and mineral build-up is difficult to remove without the use of chemicals. Furthermore, if the lime and mineral build-up is not frequently removed, the heating element is subject to failure.

Conventionally, rethermalizing heaters used for reheating of bagged food product or sink heaters used for sterilizing dishware use a two tank system. One tank is used to collect debris from the system. The debris collecting tank has a ball valve drain. The other tank contains the heating element or elements and is separated to avoid sludge or debris from collecting in it. The second tank has a removal cap on a small drain. Frequently, however, the tank having the substantially clean solution gets contaminated when the first debris collecting tank is not sufficiently drained and flushed frequently enough or completely enough. Furthermore, limescale build-up or mineral build-up occurs in the heated tank that is difficult to remove without the use of chemicals. When the heated tank gets contaminated with scale or debris, the unit may malfunction and the heating elements are subject to failure. Such frequent failures create a major service problem and an increase in warranty costs due to failures.

Further, conventional rethermalizing or sanitizing heating systems use pumps to recirculate fluid through the heating element and into a fluid tank. Such pumping systems are plagued with mechanical pump failures and require routine pump maintenance.

Accordingly, there is a need for a rethermalizing heater or sink heater that uses a heating element that is not submerged in the solution. Further, there is a need for a rethermalizing heater or sink heater that utilizes a single tank. Further still, there is a need for a rethermalizing heater or sink heater that is easily cleaned and easily drained. Yet Further still, there is a need for a rethermalizing heater or sink heater that does not require the use of chemicals to remove the limescale build-up or mineral build up from heating elements. Still further, there is a need for a rethermalizing or sink heater that does not use a mechanical pump for recirculating fluid.

SUMMARY OF THE INVENTION

An exemplary embodiment of the invention relates to a flow heater system for heating fluid. The flow heater system includes a fluid receptacle and a flow tube in fluid communication with the fluid receptacle. The flow heater system also includes a heating element in conductive communication with the flow tube. Fluid flow through the flow tube is caused by thermal siphoning.

Another exemplary embodiment of the invention relates to a sink heater configured to heat and recirculate liquid in a sink. The sink heater includes a flow tube having an inlet and an outlet in fluid communication with the sink. The sink heater also includes a heating element configured to exchange heat with the flow tube. Fluid flow through the tube is caused by convection from the sink into the inlet and out of the outlet into the sink.

Further, an exemplary embodiment of the invention relates to a method for heating liquid in a fluid receptacle. The method includes providing a flow tube in fluid communication with the fluid receptacle. The method also includes providing a fluid in the fluid receptacle. Further, the method includes providing a heating element in conductive communication with the flow tube. Further still, the method includes controlling current through the heating element and creating a thermal siphoning effect in the flow tube.

BRIEF DESCRIPTION OF THE DRAWINGS

The invention will become more fully understood from the following detailed description, taken in conjunction with the accompanying drawings, wherein like reference numerals refer to like elements, in which:

FIG. 1 is a diagrammatic view of an exemplary embodiment of a rethermalizing or sink heater;

FIG. 2 is a perspective view of a flow heater apparatus;

FIG. 3 is a right side elevational view of a flow heater apparatus with side panel removed;

DETAILED DESCRIPTION OF THE PREFERRED EMBODIMENTS

Figure 4:
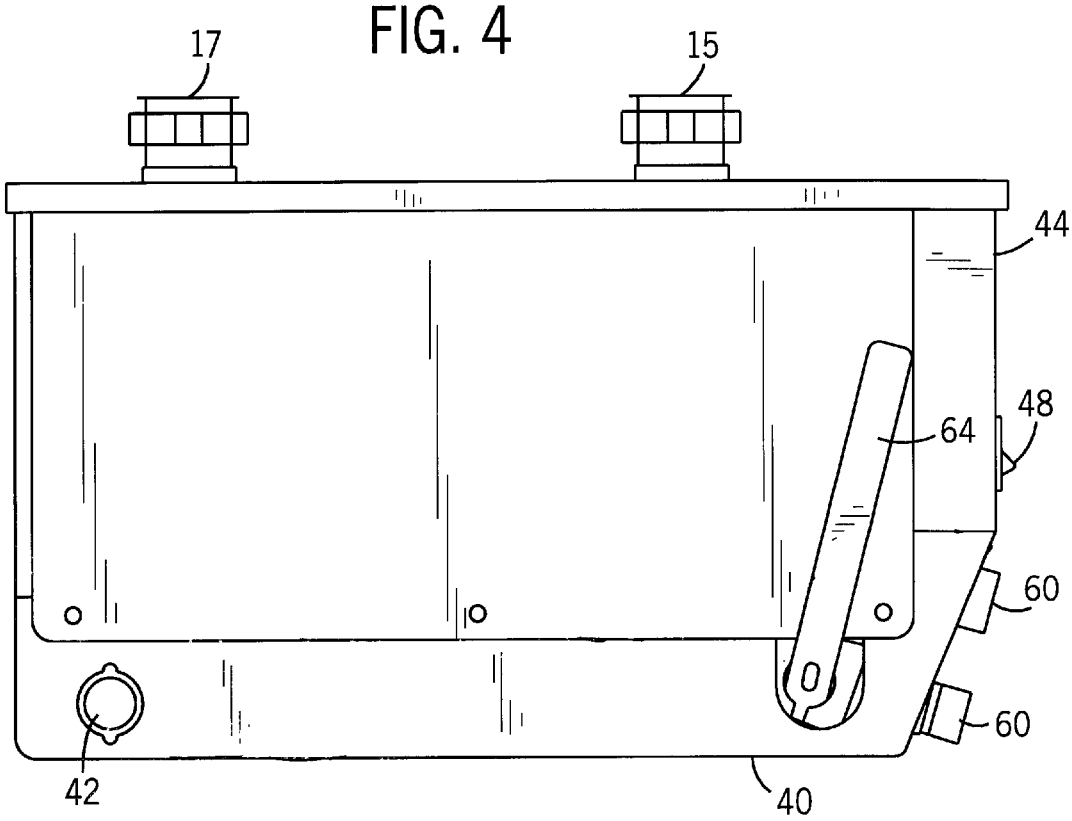
FIG. 4 is a left side elevational view of a flow heater apparatus.

Referring to FIG. 1, a flow heater 10 is coupled to a sink 20, or other fluid receptacle. In an exemplary embodiment, sink 20 may be used as a rethermalizer for reheating packages 25 of prepared food. Packages 25 are held within a rack 27. Rack 27 and packages 25 are submerged in fluid 30, such as, but not limited to, water. A drain 35 may be coupled to sink 20 for complete draining of and cleaning of sink 20.

In an alternative embodiment, sink 20 may hold a rack, similar to rack 27 which is designed to hold dishes. Utilizing a rack holding dishes, flow heater 10 may be used as a sanitizer. In an embodiment whereby sink 20 and rack 27 are used as a sanitizer, liquid 30 is a sanitizing or cleaning solution.

In operation, flow heater 10 has electrical connections 12 to at least one heating element 14 of flow heater 10, heating element 14 is wrapped around and in heat conductive contact with a flow tube 16. Cold fluid flows into an inlet 15 at the bottom of sink 20. The cold fluid entering inlet 15 is heated by contact with tube 16 which conducts heat from heating element 14. As the fluid is heated, the fluid moves upward through the angled tube and eventually exits an outlet 17 in the bottom of sink 20. The hotter fluid mixes with fluid 30 in tank 20 and rises to the top. Convection currents drive the colder fluid back into the bottom of sink 20 and into inlet 15, as the process continues.

Referring now to FIG. 2, flow heater 10 is depicted. Flow heater 10 includes heating element 14, encircling a tube 16. Tube 16 has an inlet 15 and an outlet 17. Flow heater tube 16 and heating element 14 are mounted within a flow heater housing 40. Flow heater housing 40 includes an electrical access port 42 for running electrical connections, and a control panel 44 including, but not limited to a control display panel 46 and controls 48, such as, but not limited to, a temperature setting switch and an on/off switch.

As depicted in FIG. 3, inlet 15 may be coupled to an inlet sump 52 to which may be coupled a plurality of flow tubes 16. In a preferred embodiment, flow heater 10 may utilize three flow tubes 16, especially in the case of a three phase power input. However, the design is not limited to the utilization of three tubes, a single tube design may also be used or any number of flow tubes may be applied. Flow tubes 16 are coupled to an outlet sump 54 that is coupled to outlet 17.

Figure 5:
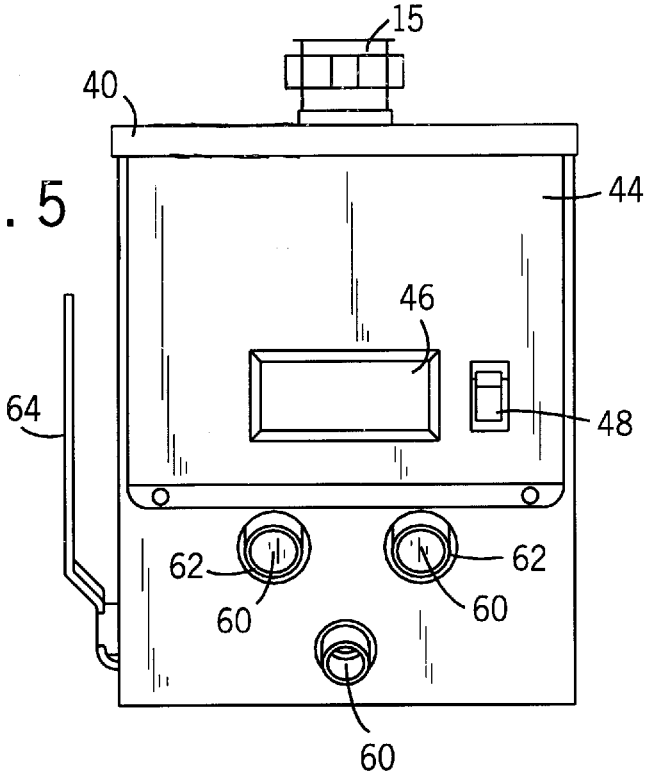
FIG. 5 is a front elevational view of a flow heater apparatus.

In an exemplary embodiment, flow tubes 16 may have cleaning ports 60 coupled to each of tubes 16. Cleaning or access to ports 60 may have caps 62, such as screw on caps or snap on caps which are preferably removable and seal flow tubes 16. In an exemplary embodiment, an access port 60 or any number of access ports 60 may utilize a valve instead of, or in combination with caps 62. As depicted in the exemplary embodiment of FIGS. 4 and 5, the bottommost access port includes a valve which is operable by a valve handle 64 rotatably mounted on the side of housing 40. Valve handle 64 provides easy access to flow tube 16, that is coupled to the bottommost access port 60, by a simple rotation of valve lever 64. Access port 60 may be used for draining of the flow heater system along with easy access for cleaning. Each of access ports 60 may be utilized for access to tube 16 for cleaning. In order to provide cleaning, an access tube is opened, either by removal of a cap 62, or by operation of valve lever 64. A brush, or other cleaning tool may then be introduced into access ports 60 and further into flow tubes 16, and thereby abrade the inner surfaces of tube 16.

Figure 6:
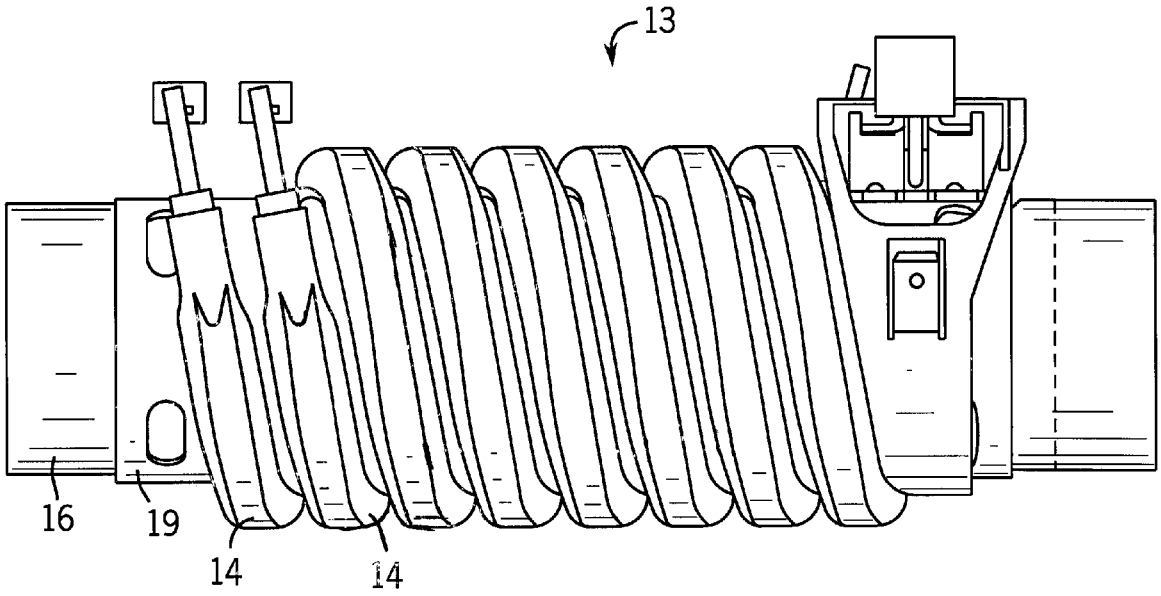
FIG. 6 is a mechanical diagram of an elevational view of a flow heater apparatus heating element.
Figure 7:
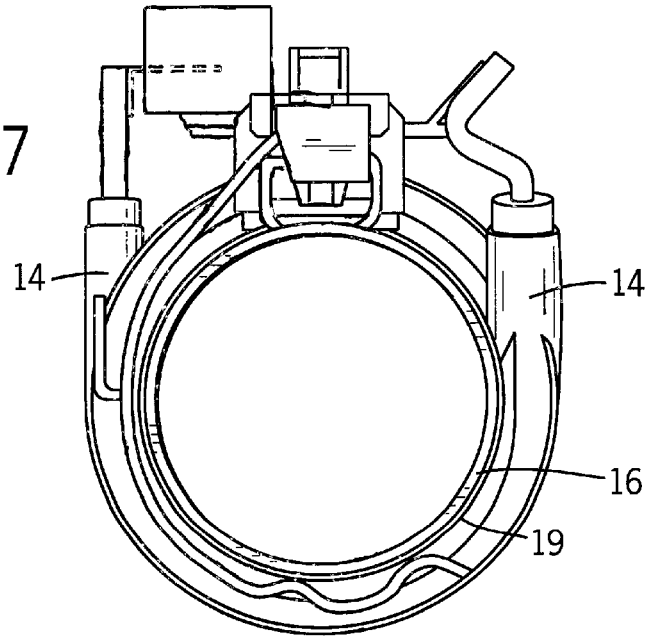
FIG. 7 is a mechanical diagram of a front elevational view of a sink heater apparatus heating element.

As depicted in FIGS. 6 and 7 an exemplary embodiment of heating element assembly 13 utilized for flow heater 10 is available from Schoeller-Bleckmann Edelstahlrohr of Austria. Heating element assembly 13 includes at least one heating element 14, however as shown in FIG. 6, multiple heating elements (as shown two heating elements) may be utilized to surround a flow tube 16. Flow tube 16 may be a stainless steel cylindrical tube, as depicted in FIG. 7. As depicted in FIG. 7, flow tube 16 may be a stainless steel tube approximately 1½ inches in diameter. However, other geometries of flow tubing may be utilized without departing from the spirit and scope of the invention. A conductive sleeve, such as an aluminum sleeve 19, may be in conductive contact with tube 16 to provide improved heat transfer to fluid flowing through tube 16. In an exemplary embodiment, heating element 14 surrounds flow tube 16 in a helical manner. Heating element 14 is furnace braised to flow tube 16 such that stainless tube 16 and aluminum sleeve 19 and spiral heating elements 14 are bonded as a single piece for advantageous heat transfer characteristics. In an exemplary embodiment, heating element assembly 13 provides approximately 95–97 percent efficiency.

In an exemplary embodiment, each heating element assembly 13 can carry up to four kilowatts of energy and may utilize single or three phase power dependent on the number of tubes 16 and heating elements 14. In an exemplary embodiment, flow heater 10 may operate at 12 kilowatts, 240 volts, utilizing three phase power. However, it should be noted that the invention is not limited to the aforementioned efficiencies, power consumption, operating conditions, or inputs.

In an exemplary embodiment, each of tubes 16 has an access port 60 that can be easily accessed with a cleaning brush from the front of housing 40. Each of tubes 16 are connected in parallel to sumps 52 and 54 which, in an exemplary embodiment, are cast aluminum chambers. The chambers are sealed to tubes 16 by flaring the ends of tubes 16 and utilizing an O-ring at each tube end. The entire assembly may be held together by through bolts 65 passing from sump 52 to sump 54 parallel to the tubes and elements (see FIGS. 2 and 3).

Temperature of fluid in fluid receptacle or sink 20 is controlled by an electronic temperature control. Heating element 14 is prevented from being energized without fluid by an electronic low water cut off system. Further, each heating element 14 has a mechanical safety control built in. In case of dry firing a fusible mechanical safety control device will prevent heating elements 14 from energizing.

Flow heater 10 may be used as a sink heater or a rethermalizing heater where a constant circulation of water at elevated temperatures is desired. In an exemplary embodiment, at 12 kilowatts, 240 volts, the unit will heat about 30 gallons of water with 150° F. temperature rise per hour.

In an alternative embodiment, flow heater 10 may be used in a variety of applications including but not limited to atmospheric water heaters or hot water dispensers. For example, hot water could be maintained in a small tank using flow heater 10 to maintain the liquid contained therein at a relatively constant temperature, for dispensing on command.

As disclosed, flow heater 10 utilizes a flow tube that is tilted with an angle of approximately 5–10 degrees relative to the horizontal. However, it should be noted that flow heater 10 may utilize flow tube 16 at any of a variety of angles from 0° to 90° relative to the horizontal.

Further, in an exemplary embodiment, heating elements 14 are braised on providing direct contact with tubes 16. However, heating elements 14 need not be fixedly attached to tube 16 nor need they be in physical contact with tubes 16. However, differing heat transfer results will be achieved depending on the method of contact. Furthermore, in an exemplary embodiment, heating elements 14 have a substantially flat surface to provide a greater surface area in contact with tube 16.

However, the invention is not limited to heating elements with a flat surface.

While the exemplary embodiments refer to a flow heater for a sink heater or a rethermalizing heater, the present invention may also be applied to other types of recirculating heating systems.

Further, those who have skill in the art will recognize that the present invention is applicable with many different hardware configurations and processes.

While the detailed drawings, specific examples, and particular formulations given describe exemplary embodiments, they serve the purpose of illustration only. The material and configurations shown and described may differ depending on the chosen performance characteristics and physical characteristics of the disclosed devices. For example, the type and capacity of the heating elements used may differ. The systems shown and described are not limited to the precise details and conditions disclosed. Furthermore, other substitutions, modifications, changes, and omissions may be made in the design, operating conditions, and arrangement of the preferred embodiments without departing from the spirit of the invention as expressed in the appended claims.

What is claimed is:

1. A flow heater system for heating fluid, the flow heater system comprising:

a fluid receptacle;

a flow tube in fluid communication with the fluid receptacle; and a heating element in conductive communication with the flow tube, a flow tube access port in coaxial alignment with the flow tube, the flow tube access port providing exterior access to the interior of the flow tube, wherein fluid flow through the flow tube is caused by thermal siphoning.

2. The flow heater system of claim 1, wherein the flow tube has an inlet and an outlet.

3. The flow heater system of claim 1, wherein fluid is recirculated though the flow tube into and out of the fluid receptacle.

4. The flow heater system of claim 1, further comprising:

a valve providing selective access through the flow tube access port.

5. The flow heater system of claim 1, further comprising:

a removable flow tube access port cover providing selective access through the flow tube port.

6. The flow heater system of claim 1, further comprising:

a control unit in communication with the heating element and configured to control the power output of the heating element.

7. The flow heater system of claim 1, further comprising:

more than one flow tube.

8. The flow heater system of claim 1, further comprising:

more than one heating element.

9. The flow heater system of claim 1, wherein the receptacle is configured to hold dishware for sanitizing.

10. The flow heater system of claim 1, wherein the receptacle is configured to hold packaged food for rethermalizing.

11. A sink heater configured to heat and recirculate liquid in a sink, comprising:

an inlet tube extending substantially vertically from the sink;

an outlet tube extending substantially vertically from the sink;

a flow tube having an inlet and an outlet in fluid communication with the sink and extending between the inlet and outlet tubes at an angle that is non-orthogonal to the vertical axes of the inlet and outlet tubes; and a heating element configured to exchange heat with the flow tube, wherein fluid flow through the tube is caused by convection from the sink into the inlet and out of the outlet into the sink.

12. The sink heater of claim 11, further comprising:

a flow tube access port, providing access to the interior of the flow tube.

13. The sink heater of claim 12, further comprising:

a valve providing selective access through the flow tube access port.

14. The sink heater of claim 12, further comprising:

a removable flow tube access port cover providing selective access through the flow tube port.

15. The sink heater of claim 11, further comprising:

a control unit in communication with the heating element and configured to control the power output of the heating element.

16. The sink heater of claim 11, wherein the sink has a rack for holding dishware.

17. The sink heater of claim 11, wherein the sink has a rack for holding packaged foods.

18. A method for heating liquid in a fluid receptacle, comprising:

providing a flow tube in fluid communication with the fluid receptacle;

providing a fluid in the fluid receptacle;

providing a heating element in conductive communication with the flow tube;

controlling current through the heating element;

creating a thermal siphoning effect in the flow tube; and providing a flow tube access port in coaxial alignment with the flow tube for selective exterior access to the interior of the flow tube.

19. The method of heating liquid of claim 18, further comprising:

stopping current in the heating element when liquid flow through the tube is substantially stopped.

* * * * *